US010722090B2

(12) United States Patent
Schultink et al.

(10) Patent No.: US 10,722,090 B2
(45) Date of Patent: Jul. 28, 2020

(54) AUTONOMOUSLY DRIVEN FLOOR VACUUM CLEANER, METHOD FOR VACUUM CLEANING AND USE OF AN AUTONOMOUSLY DRIVEN FLOOR VACUUM CLEANER

(71) Applicant: Eurofilters N.V., Overpelt (BE)

(72) Inventors: Jan Schultink, Overpelt (BE); Ralf Sauer, Overpelt (BE)

(73) Assignee: EUROFILTERS N.V., Overpelt (BE)

( * ) Notice: Subject to any disclaimer, the term of this patent is extended or adjusted under 35 U.S.C. 154(b) by 82 days.

(21) Appl. No.: 15/544,399

(22) PCT Filed: Jan. 19, 2016

(86) PCT No.: PCT/EP2016/050944
§ 371 (c)(1),
(2) Date: Jul. 18, 2017

(87) PCT Pub. No.: WO2016/116417
PCT Pub. Date: Jul. 28, 2016

(65) Prior Publication Data

US 2018/0000305 A1 Jan. 4, 2018

(30) Foreign Application Priority Data

Jan. 20, 2015 (EP) ..... 15151818

(51) Int. Cl.
*A47L 9/28* (2006.01)
*A47L 5/36* (2006.01)
(Continued)

(52) U.S. Cl.
CPC ..... *A47L 9/2852* (2013.01); *A47L 5/225* (2013.01); *A47L 5/362* (2013.01); *A47L 9/0411* (2013.01);
(Continued)

(58) Field of Classification Search
CPC ..... A47L 9/2852; A47L 5/225; A47L 9/0411; A47L 9/0477; A47L 9/0606;
(Continued)

(56) References Cited

U.S. PATENT DOCUMENTS 2,101,390 A 12/1937 Gorissen
2,036,056 A 3/1939 Kroenlein
(Continued)

FOREIGN PATENT DOCUMENTS

CA 2 498 435 A1 8/2006
CN 1121797 A 5/1996
(Continued)

OTHER PUBLICATIONS

International Search Report dated Mar. 21, 2016 for International Application No. PCT/EP2016/050944.
(Continued)

*Primary Examiner* — David Redding
(74) *Attorney, Agent, or Firm* — Brinks Gilson & Lione

(57) ABSTRACT

The present invention relates to an autonomously operable vacuum cleaner that has a modular design. The vacuum cleaner in this respect comprises a cleaning head module as well as a separate canister module. The cleaning head module and the canister module are in this respect connected to one another via a hose so that dust sucked in via the cleaning head module can be conveyed into the canister module.

12 Claims, 1 Drawing Sheet

(51) Int. Cl.

| | |
|---|---|
| ***A47L 9/24*** | (2006.01) |
| ***A47L 5/22*** | (2006.01) |
| ***A47L 9/16*** | (2006.01) |
| ***A47L 9/22*** | (2006.01) |
| ***A47L 9/04*** | (2006.01) |
| ***A47L 9/06*** | (2006.01) |

(52) U.S. Cl.

CPC ..... *A47L 9/0477* (2013.01); *A47L 9/0606* (2013.01); *A47L 9/1666* (2013.01); *A47L 9/1683* (2013.01); *A47L 9/22* (2013.01); *A47L 9/246* (2013.01); *A47L 9/2805* (2013.01); *A47L 9/2884* (2013.01); *A47L 9/2894* (2013.01); *A47L 2201/00* (2013.01); *A47L 2201/04* (2013.01); *A47L 2201/06* (2013.01)

(58) Field of Classification Search

CPC ..... A47L 9/1666; A47L 9/1683; A47L 9/22; A47L 9/2805; A47L 9/2884; A47L 9/2894; A47L 5/362; A47L 9/246; A47L 2201/00; A47L 2201/06; A47L 2201/04; A47L 9/26

IPC ..... A47L 9/28

See application file for complete search history.

(56) References Cited

U.S. PATENT DOCUMENTS

| | | | | |
|---|---|---|---|---|
| 2,482,337 | A | 9/1949 | Hahn | |
| 3,876,255 | A | 4/1975 | Ilon | |
| 4,519,112 | A | 5/1985 | Bevington et al. | |
| 4,644,606 | A | 2/1987 | Luerken et al. | |
| 5,573,369 | A | 11/1996 | Du | |
| 5,815,880 | A | 10/1998 | Nakanishi | |
| 6,171,054 | B1 | 1/2001 | Mann, III et al. | |
| 6,719,830 | B2 | 4/2004 | Illingworth et al. | |
| 7,113,847 | B2 * | 9/2006 | Chmura | A47L 5/36 318/568.1 |
| 2002/0159897 | A1 | 10/2002 | Kegg et al. | |
| 2003/0202890 | A1 | 10/2003 | Bundy | |
| 2004/0200505 | A1 | 10/2004 | Taylor et al. | |
| 2004/0211318 | A1 | 10/2004 | Morgan | |
| 2006/0191098 | A1 | 8/2006 | Hiebert | |
| 2007/0272463 | A1 | 11/2007 | Yu et al. | |
| 2010/0256812 | A1 | 10/2010 | Tsusaka et al. | |
| 2013/0292918 | A1 | 11/2013 | Schlee et al. | |

FOREIGN PATENT DOCUMENTS

| | | | |
|---|---|---|---|
| CN | 1164825 | A | 11/1997 |
| CN | 1041672 | C | 1/1999 |
| CN | 1013 84973 | A | 3/2009 |
| CN | 203000795 | U | 6/2013 |
| CN | 1033 69995 | A | 10/2013 |
| DE | 298 03 415 | U1 | 6/1998 |
| DE | 298 12 377 | U1 | 10/1998 |
| DE | 20 2004 002284 | U1 | 8/2004 |
| DE | 10 2008 019 976 | A1 | 10/2009 |
| DE | 10 2008 046942 | A1 | 3/2010 |
| DE | 10 2011 083 319 | A1 | 3/2013 |
| DE | 20 2013 008 870 | U1 | 12/2013 |
| DE | 10 2013 100 192 | A1 | 7/2014 |
| EP | 1 360 922 | A2 | 11/2003 |
| EP | 1360922 | A2 | 11/2003 |
| EP | 2 030 551 | | 3/2009 |
| EP | 2 420 169 | A1 | 2/2012 |
| EP | 2 420 171 | A1 | 2/2012 |
| EP | 2 741 483 | A2 | 6/2014 |
| EP | 2 979 742 | A1 | 2/2016 |
| EP | 3 047 771 | A1 | 7/2016 |
| FR | 2 847 791 | A1 | 6/2004 |
| GB | 139 892 | A | 3/1920 |
| GB | 419 191 | A | 11/1934 |
| GB | 554 177 | A | 5/1941 |
| GB | 2 344 750 | A | 6/2000 |
| JP | H07 320 | A | 1/1995 |
| JP | 2005 027829 | A | 2/2005 |
| KR | 2005 0069018 | A | 7/2005 |
| KR | 10 2007 01010 | | 4/2006 |
| KR | 2006 0034851 | A | 4/2006 |
| WO | WO 2002/058527 | A1 | 8/2002 |
| WO | WO 2002/074150 | A1 | 9/2002 |
| WO | WO 2007/068444 | A1 | 6/2007 |
| WO | WO 2007/093926 | A1 | 8/2007 |
| WO | WO 2007/117095 | A1 | 10/2007 |
| WO | WO 2008/002027 | A1 | 1/2008 |

OTHER PUBLICATIONS

Office Action dated Feb. 3, 2020, for Chinese Patent Application No. 201680006627.5 (5 pages) (English translation).

* cited by examiner

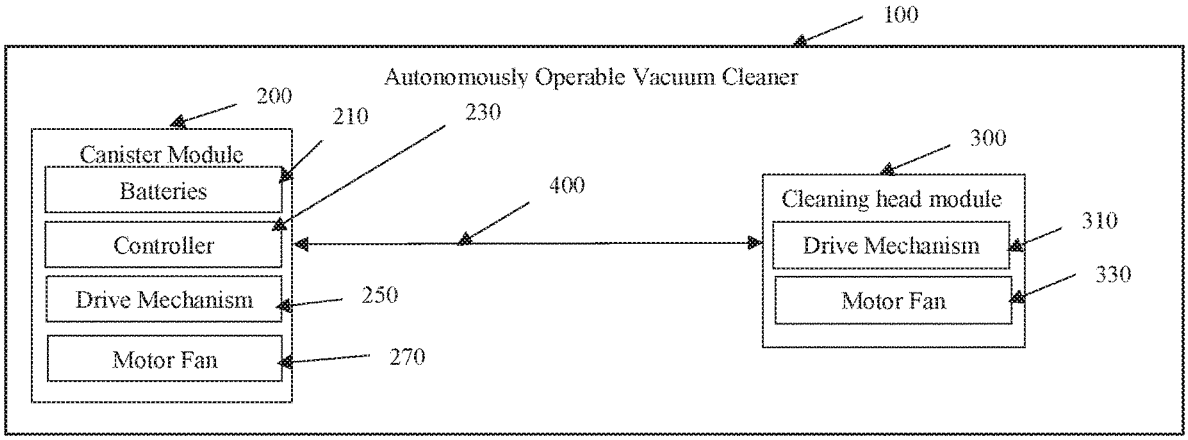
100
Autonomously Operable Vacuum Cleaner
200
Canister Module
210
Batteries
230
Controller
400
Drive Mechanism
250
Motor Fan
270
300
Cleaning head module
310
Drive Mechanism
330
Motor Fan

AUTONOMOUSLY DRIVEN FLOOR VACUUM CLEANER, METHOD FOR VACUUM CLEANING AND USE OF AN AUTONOMOUSLY DRIVEN FLOOR VACUUM CLEANER

This application claims the benefit under 35 U.S.C. § 371 of International Application No. PCT/EP2016/050944, filed Jan. 19, 2016, which claims the benefit of European Patent Application No. 15151818.0, filed Jan. 20, 2015; which are incorporated by reference herein in their entirety.

The present invention relates to an autonomously operable vacuum cleaner that has a modular design. The vacuum cleaner in this respect comprises a cleaning head module as well as a separate canister module. The cleaning head module and the canister module are in this respect connected to one another via a hose so that dust sucked in via the cleaning head module can be conveyed into the canister module. Both the cleaning head module and the canister module in this respect each have a drive mechanism that provides independent mobility to the respective modules. In addition, the autonomously operable vacuum cleaner comprises a motor fan unit that is accommodated either in the canister module or in the cleaning head module. The invention is characterized in that the connection of the cleaning head module to the hose and/or the connection of the hose to the canister module is configured as releasable, in particular irreversibly releasable. Various possibilities of use of an autonomously operable vacuum cleaner in accordance with the invention result in this manner.

In addition, the invention relates to a method of vacuum cleaning by means of an above-described autonomously operable vacuum cleaner.

In addition, the present invention relates to the use of an autonomously operable vacuum cleaner, in particular as a suction unit and/or as a power supply for tools.

So-called autonomous vacuum cleaners or robot vacuum cleaners are known from the prior art. Examples for such robot vacuum cleaners are described, for example, in EP 2 741 483, DE 10 2013 100 192 and US 2007/0272463. As a rule, they have a canister module in which a motor fan unit is accommodated by means of which the vacuum for the suction procedure during vacuum cleaning is provided. In addition to the canister unit, such vacuum cleaners have a cleaning head module; the actual suction process in this respect takes place by means of the cleaning head module. The cleaning head module and the canister module are in this respect connected to one another by means of a suction hose such that the vacuum generated by the canister module is passed on to the cleaning head module for vacuum cleaning. Both the cleaning head module and the canister module in this respect have autonomous mechanisms by means of which both the cleaning head module and the canister module are movable independently of one another. The separate movability of the two components is naturally limited to the length or to the flexibility of the hose connecting the two modules.

It is equally known from the prior art to integrate a mechanism into such an autonomous vacuum cleaner by means of which the autonomous vacuum cleaner can carry out an independent cleaning option of spaces. This mechanism, for example, provides that the surrounding space is analyzed and recognized by the vacuum cleaner itself so that obstacles can be driven around.

It is in particular disadvantageous with the initially described vacuum cleaners that they have low flexibility since the cleaning head module is always fixedly connected to the canister module and the vacuum cleaner, that is of high quality per se, is thus restricted to the independent cleaning function.

Starting from this prior art, it is the object of the present invention to further increase the flexibility of an autonomous vacuum cleaner in accordance with the above-described design principles and to add further functional options to such a vacuum cleaner.

This object is achieved with respect to an autonomously operable vacuum cleaner by the features of claim 1, with respect to a method of vacuum cleaning by the features of claim 11, and with respect to usage options by the features of claim 15. The respective dependent claims in this respect set forth advantageous further developments.

BRIEF DESCRIPTION OF THE DRAWINGS

FIG. 1 shows an embodiment of an autonomously operable vacuum cleaner.

The invention thus relates to an autonomously operable vacuum cleaner 100 comprising a cleaning head module 300, a canister module 200 with rechargeable batteries 210 that is separate from the cleaning head module 300, and a control 230 that carries out a navigation function to provide an autonomous control of the vacuum cleaner 100, as well as a hose 400 that fluidically and electrically connects the cleaning head module 300 to the canister module 200, wherein both the cleaning head module 300 and the canister module 200 each have a drive mechanism 250, 310 that provides independent mobility to the respective modules, wherein the canister module 200 or the cleaning head module 300 comprises a motor fan 270, 330 unit by means of which a vacuum is made possible to suck in air via the cleaning head module 300 into the canister module 200, and wherein the connection of the cleaning head module 300 to the hose 400 and/or the connection of the hose 400 to the canister module 200 is/are configured as releasable.

In the autonomously operable vacuum cleaner in accordance with the invention the canister module thus has an energy storage unit, i.e. rechargeable batteries, by means of which the energetic supply of all the components of the vacuum cleaner is possible. The cleaning head module is in this respect connected to the canister module by means of a suction hose; the dust sucked in by the cleaning head module is collected into the canister module and is separated therein. Both the cleaning head module and the canister module in this respect have independent drive mechanisms so that the cleaning head module is movable separately from the canister module—as part of the mobility prescribed by the length and/or flexibility of the hose. The canister module and the cleaning head module are in this respect equally electrically connected to one another so that, for example, the drive unit of the cleaning head module and—where integrated in the cleaning head module—the motor fan unit can be supplied with electrical energy from the rechargeable batteries located in the canister module.

The vacuum cleaner that is autonomously operable in accordance with the invention is now characterized in that the cleaning head module and the canister module can be separated from one another.

Such a separability of the individual modules from one another makes possible a diverse spectrum of further usage options of the autonomously operable vacuum cleaner, in particular of the canister module. These individual options will be presented separately in the following.

Both the canister module and the cleaning module can in this respect and independently of one another have three or four wheels, in particular exactly three wheels or exactly four wheels. The drive mechanism of the canister module or of the cleaning module can in this respect be configured to drive one of the wheels, a plurality of the wheels or all the wheels of the dust collection unit. The drive mechanism for each drivable wheel can have a separate or independent drive unit. This allows an independent or autonomous driving of each wheel.

The drive mechanism of the canister module can be configured apart or separately from the drive mechanism of the cleaning module. The canister module and the cleaning module can in particular be driven independently of one another. They can move in different directions, for example. One of the two modules can also not be moved while the other is moved.

In the above-described autonomously operable vacuum cleaner, one of the wheels, a plurality of the wheels or all the wheels of the canister module and/or one of the wheels, a plurality of the wheels or all the wheels of the cleaning head module can be omnidirectional wheels. The use of omnidirectional wheels makes possible a very flexible and versatile movement of the canister module and of the cleaning module respectively.

Each omnidirectional wheel has a plurality of rotatably supported rollers or roller bodies at its circumference whose axes do not extend in parallel with the wheel axis (of the omnidirectional wheel). The axes of the rollers can in particular extend or be aligned obliquely or transversely with respect to the wheel axis. An example for an omnidirectional wheel is a Mecanum wheel that is inter alia described in U.S. Pat. No. 3,876,255.

The motor fan unit can be configured such that it generates a volume flow of more than 30 l/s, in particular more than 35 l/s, with a power rating of less than 450 W in accordance with DIN EN 60312-1 at aperture 8. The motor fan unit can alternatively or additionally be configured such that it generates a volume flow of more than 25 l/s, in particular more than 30 l/s, with a power rating of less than 250 W in accordance with DIN EN 60312-1 at aperture 8. The motor fan unit can alternatively or additionally be configured such that it generates a volume flow of more than 10 l/s, in particular more than 15 l/s, with a power rating of less than 100 W in accordance with DIN EN 60312-1 at aperture 8.

A particularly efficient robot vacuum cleaner is obtained in this manner that in particular has a greatly increased suction power in comparison with conventional robot vacuum cleaners.

The air data of a vacuum cleaner or of a motor fan unit are determined in accordance with DIN EN 60312-1:2014-01. Reference is in particular made to section 5.8. In this respect, the measuring device in design B in accordance with section 7.3.7.3 is used. If a motor fan unit without a vacuum cleaner housing is measured, measuring device B is likewise used. The statements in section 7.3.7.1 apply to intermediate pieces that may be necessary for connection to the measuring chamber.

The terms "volume flow" and "suction air flow" are also used for the term "air flow" in accordance with DIN EN 60312-1.

A preferred embodiment provides that the releasable connection of the cleaning head module to the hose and/or the connection of the hose to the canister module is configured as a plug-in connection, as a plug-in connection with a snap-in option or as a screw connection.

It is furthermore advantageous that the canister module provides power and/or control signals to the cleaning head module via at least one electric line that is integrated in the hose or that extends in parallel therewith.

Provision is made in accordance with a further preferred embodiment that the at least one electric line is configured as releasable, preferably configured as releasable between the canister module and the hose and/or between the hose and the cleaning head module, and is in particular configured as a plug-in connection between the canister module and the hose and/or between the hose and the cleaning head module.

The plug-in connection of each electric line can, for example, comprise a socket at the canister module and a plug at the hose connectable to the socket of the canister module, and a socket at the cleaning head module, and a further plug connectable to the socket of the cleaning head module at the hose or a socket at the hose and a plug at the canister module connectable to the socket of the hose and a socket at the cleaning head module and a plug connectable to the socket of the cleaning head module at the hose or a socket at the hose and a plug connectable to the socket of the hose at the canister module and a further socket at the hose and a plug connectable to the further socket of the hose at the cleaning head module or a socket at the canister module and a plug connectable to the socket of the canister module at the hose and a socket at the hose and a plug connectable to the socket of the hose at the cleaning head module.

The separability of the cleaning head module and of the canister module produces a number of new usage options.

The cleaning head module can in particular be released from the hose connected to the canister module having a motor fan unit and can be replaced with a driveless cleaning head to be operated by a user or with a cleaning tool, in particular a crevice tool, an upholstery tool or a furniture brush.

Alternatively to this, it is equally possible that the hose can be released from the canister module having a motor fan unit together with the cleaning head module and can be replaced with a further hose to which a driveless cleaning head to be operated by a user or a cleaning tool, in particular a crevice tool, an upholstery tool or a furniture brush, is attached.

The motor fan unit is arranged in the canister module in the above-named embodiments. The cleaning head module is in this respect separated from the canister module either at the hose or together with the hose and is replaced with a cleaning head or cleaning tool, etc. manually operable by a user. This cleaning head connected to the canister module or the cleaning tool advantageously also comprises a suction hose via which the connection to the canister module takes place. This allows the use of the vacuum cleaner, that is equally operable as autonomous, as a full-featured vacuum cleaner operable by a user.

A second possibility provides that a suction pipe to be operated by the user is inserted between the hose and the cleaning head module and the cleaning head module can be operated by the user by means of the suction pipe. Alternatively or additionally to the suction pipe, an additional suction hose can be inserted between the cleaning module and the canister module, preferably at the side of the canister module, to extend the already present suction hose.

The operating concept presented here is similar to the operating concept described further above; the cleaning head module can also be operated manually by the user here using the suction pipe so that the autonomously operable vacuum cleaner can equally be converted into a full-featured manual vacuum cleaner, i.e. into a vacuum cleaner that can be operated by a user.

Not only the change of function of a robot vacuum into a fully functional vacuum cleaner that is suitable for a basic cleaning in manual operation is thus made possible by the above-described embodiments; so-called "above-floor work" is thus equally possible, i.e. drapes, etc. can e.g. be cleaned.

It is in particular of advantage in this respect if the control of the vacuum cleaner, in particular of the canister module, carrying out the navigation function is deactivated by a user in the case of a replacement of the cleaning head module and the drive function can be set to idle or can be brought into an operation mode in which the control carrying out the navigation function allows the canister module to follow the user.

The user thus has the choice whether he sets the canister module into a quasi-autonomous operating state in which the canister module follows the user; this function can also be called a "follow me" function. In this case, the navigation function is configured such that it recognizes a user and follows him in the event that the user, for example, moves over a predefined distance away from the canister module.

It is, however, equally possible alternatively to this to set the drive function of the canister module to idle so that the vacuum cleaner thereby resulting can be operated like a conventional vacuum cleaner and the canister module can thus, for example, be "pulled along", for example via the suction hose.

The control contained in the autonomously operable vacuum cleaner preferably has at least one sensor for mapping the surrounding space, in particular at least one camera sensor, sonar sensor, lidar sensor, infrared sensor or 3D scanner sensor; the control is in this respect equally able to receive and/or process the data generated by the above-named sensors. A three-dimensional map of the space is preferably generated in this respect so that the autonomously operable vacuum cleaner can drive around obstacles in the space, for example, and/or can carry out an autonomous route selection.

The described autonomously operable vacuum cleaners can comprise a control and navigation device for an independent traveling of the cleaning module and/or of the canister module. An autonomous vacuuming by the autonomously operable vacuum cleaner is thus made possible. The control and navigation device can in particular be configured for a control of the drive mechanism of the canister module, of the drive mechanism of the cleaning head module and/or of the motor fan unit. The control and navigation device can be arranged at or in the canister module and/or at or in the cleaning head module. The control and navigation device can in particular only be arranged at or in the canister module. In this case, the control and navigation of the cleaning head module can also be carried out at the side of the canister module.

The described autonomously operable vacuum cleaners can have a device for transmitting control signals from the control and navigation device to the cleaning head module. The device for transmitting control signals can be adapted for the configuration of a wired or wireless transmission.

The described autonomously operable vacuum cleaners can comprise one or more devices for orientation. The devices for orientation can in particular be cameras, path sensors and/or distance sensors. The distance sensors can, for example, be based on sound waves or electromagnetic waves. The devices for orientation can be arranged at or in the canister module and/or at or in the cleaning head module.

It is additionally advantageous if the canister module comprises at least one unit for separating sucked-in dust (dust collection unit), wherein the unit for separating sucked-in dust is in particular selected from the group comprising a vacuum filter bag, a cyclone and an impact separator. The dust collection unit can be configured and/or the motor fan unit can be arranged such that no contact of the fan wheel of the motor fan unit with a test probe in accordance with IEC/EN 60335 is possible by the floor tool. Reference is made here to section 8 of the version DIN EN 60335-1 2012-10. Test probe B should in particular be used.

This reduces the risk of damage to the motor fan unit and the risk of injury when touching the floor tool when the motor is running.

Alternatively, the autonomously operable vacuum cleaner can be a bagless vacuum cleaner, in particular having an outlet filter, as described above, with a filter surface of at least 800 $cm^2$. A bagless cleaner is a vacuum cleaner in which the sucked-in dust is separated and collected without a vacuum cleaner filter bag. In this case, the canister module can comprise an impact separator or a centrifugal force separator or a cyclone separator.

The cleaning head module can have a base plate having a base surface that faces the surface to be vacuumed in the operation of the autonomously operable vacuum cleaner, with the base plate having at least one air flow passage that is in parallel with the base surface and that has an opening provided laterally in the base plate. The base surface of the base plate can in particular lie on the surface to be vacuumed in operation of the autonomously operable vacuum cleaner or can be spaced apart therefrom, for example by means of a brush strip. The base plate can have at least one curved air flow passage in parallel with the base surface. The curved air flow passage can have the form of a circular ring or of a circular ring section.

The base plate is also called a tool base. The floor tool has a suction opening for establishing a fluidic connection to the motor fan unit. This suction opening is in fluidic communication with the at least one air flow passage. The contact pressure of the floor tool is set in an advantageous manner with a good suction power by the at least one air flow passage, in particular one or more air flow passages.

The cleaning head module can generally be an active or a passive floor tool. An active floor tool has a brush roller (sometimes also called a bristle brush and/or a rotary brush) in the suction opening. The brush roller can be drivable by an electric motor. A passive cleaning head module does not have a brush roller.

In the described autonomously operable vacuum cleaners, a very good efficiency and suction power can also be achieved with a passive cleaning head module, that is without a brush roller, due to the overall design. On a use of passive cleaning head modules, the design is simplified and the weight of the floor tool is thus reduced, whereby the drive device of the cleaning head modules has a lower power requirement.

A further preferred embodiment provides that the cleaning head module and/or the driveless cleaning head optionally replacing the cleaning head module has at least one cleaning brush, preferably at least one cleaning brush rotatable by means of a motor.

The autonomously operable vacuum cleaner can be a bag vacuum. A bag vacuum is a vacuum cleaner in which the sucked-in dust is separated and collected in a vacuum cleaner filter bag. The filter surface of the vacuum cleaner filter bag can amount to at least 800 $cm^2$. The autonomously operable vacuum cleaner can in particular be a bag vacuum for disposable bags.

The filter surface of a vacuum cleaner filter bag designates the total surface of the filter material that is located between or within the seams (for example, weld seams or adhesive seams) at the marginal side. Any side gussets or surface gussets possibly present must also be taken into account in this respect. The surface of the bag filling opening or inlet opening (including a seam surrounding this opening) is not part of the filter surface.

The vacuum cleaner filter bag can be a flat bag or can have a square base shape. A flat bag is formed by two side walls of filter material that are connected (for example welded or adhesively bonded) to one another along their peripheral margins. The bag filling opening or the inlet opening can be provided in one of the two side walls. The side surfaces or side walls can each have a rectangular base shape. Each side wall can comprise one or more layers of fiber mats and/or nonwovens.

The autonomously operable vacuum cleaner in the form of a bag vacuum can comprise a vacuum cleaner filter bag wherein the vacuum cleaner filter bag is configured in the form of a flat bag and/or as a disposable bag.

The bag wall of the vacuum cleaner filter bag can comprise one or more layers of a fiber mat and/or one or more layers of a nonwoven. It can in particular be a laminate of one or more layers of a fiber mat and/or of one or more layers of a nonwoven. Such a laminate is described, for example, in WO 2007/068444.

The term nonwoven is understood in the sense of the standard DIN EN ISO 9092:2010. Film structures and paper structures, in particular filter paper, are in this respect in particular not considered nonwovens. A "nonwoven" is a structure of fibers and/or continuous filaments or short-fiber yarns that were formed by any method to an area-measured material (with the exception of the interweaving of yarns such as in woven fabric, knitted fabric, knit fabric, lace or tufted fabric), but were not joined by any method. A fiber mat becomes a nonwoven by a joining method. The fiber mat or nonwoven can be dry laid, wet laid or extruded.

The autonomously operable vacuum cleaner can comprise an outlet filter, in particular having a filter surface of at least 800 $cm^2$. The outlet filter can in particular be pleated or folded. A large surface can thus be achieved with a smaller base surface. In this respect, the outlet filter can be provided in a holder such as is described in European patent application No. 14 179 375.2. Such outlet filters allow the use of vacuum cleaner filter bags of low separation power, for example of single-layer vacuum cleaner filter bags. A bag can be used as a vacuum cleaner filter bag of low separation power, for example, in which the filter material of the bag wall comprises a spun bond that has a mass per unit area of 15 $g/m^2$ to 100 $g/m^2$. The vacuum cleaner filter bag can therefore in particular be configured in one layer. Alternatively, for example, a bag can be used in which the filter material of the bag wall comprises a laminate of a spun bond, of a meltblown and of a further spun bond (SMS).

The motor fan unit can have a radial fan, in particular a single-stage radial fan. In a radial fan, the air is sucked in in parallel with or axially to the drive axis of the impeller and is deflected, in particular deflected by approximately 90°, by the rotation of the impeller and is radially expelled.

The suction hose can have a diameter in a range from 25 mm to 50 mm and/or a length in a range from 500 mm to 2500 mm. The suction hose can be flexible, in particular such that it is deformable on a proper use of the autonomously operable vacuum cleaner. The suction hose can be partly or completely composed of plastic. It can in particular comprise a plastic wall and/or a reinforcement of metal (for example a spiral wire). The suction hose can be configured as a stretch hose. It thus has a variable length and can be pulled out to a multiple of its non-stretched (resting) length.

The suction hose can have a constant or a variable diameter over its length. The suction hose can in particular have a conical shape with the diameter preferably reducing toward the floor tool. The above-named diameters in particular relate to the smallest diameter of the suction hose.

The described autonomously operable vacuum cleaners are configured for an independent or autonomous covering of a surface to be cleaned.

The energy source (rechargeable batteries) contained in the canister module in particular serves in this respect the energetic supply of all energy-consuming components of the autonomously operable vacuum cleaner, that is in particular of the control, of the drive mechanisms, of the motor fan unit and of the navigation function/navigation sensors. The rechargeable batteries can in this respect in particular be Li ion rechargeable batteries.

The invention additionally relates to a method of vacuum cleaning in which, in accordance with a first embodiment, in a previously described autonomously operable vacuum cleaner, the canister module comprises a motor fan unit, the cleaning head module is released from the hose connected to the canister module and is replaced with a driveless cleaning head to be operated by a user or with a driveless cleaning tool, in particular a crevice tool, an upholstery tool or a furniture brush, and the driveless cleaning head or the cleaning tool is operated by the user for vacuum cleaning.

In accordance with a further alternative of this method of vacuum cleaning in accordance with the invention, in an above-described autonomously operable vacuum cleaner in which the canister module comprises a motor fan unit, the hose together with the cleaning head module is released from the canister module and is replaced with a further hose to which the driveless cleaning head to be operated by a user or a driveless cleaning tool, in particular a crevice tool, an upholstery tool or a furniture brush, is attached and the driveless cleaning head or the cleaning tool is operated by the user for vacuum cleaning.

It is furthermore possible in accordance with a further preferred alternative that in an autonomously operable vacuum cleaner as above, a suction pipe to be operated by the user is inserted between the hose and the cleaning head module and the cleaning head module is operated by the user by means of the suction pipe. Alternatively or additionally to the suction pipe, an additional suction hose can be inserted between the cleaning head module and the canister module, preferably at the side of the canister module, to extend the already present suction hose.

All the previously named alternative embodiments of the method in accordance with the invention for vacuum cleaning are in this respect focused on the flexible configuration of the vacuum cleaner of modular design in accordance with the invention. It is always essential in this respect that the cleaning head module is separated from the canister module and is replaced, for example, with a separate and driveless cleaning head module, for example a suction tool, etc. to be operated by the user or that a suction pipe and optionally an extended suction hose, etc. are inserted between the canister module and the cleaning head module so that the cleaning head module included in the autonomously operable vacuum cleaner can also be operated by the user.

It is in particular of advantage that a suction pipe is inserted between the hose and the driveless cleaning head or between the hose and the driveless cleaning tool for the two above first named alternative embodiments, by means of which suction pipe a user can operate the driveless cleaning head or the driveless cleaning tool.

It is preferred in the method that, in the autonomously operable vacuum cleaner, the control of the vacuum cleaner carrying out the navigation function is deactivated by a user and the drive function is set to idle or is brought into an operating mode in which the control carrying out the navigation function allows the canister module to follow the user.

In particular, in the method in accordance with the invention, the driveless cleaning head or the further hose has a releasable electrical line that is connected to the canister module and can thus be supplied with current.

The invention furthermore relates to the use of an autonomously operable vacuum cleaner operated as above. This can, for example, also be used as a suction unit and/or a power supply for separate tools, in particular drills, circular saws, cleaning devices such as window cleaning machines, polishing machines, garden equipment such as hedge shears, lawn mowers, leaf blowers, etc.

In the event that the autonomously operable vacuum cleaner is to be used as a suction unit, the cleaning head module is separated from the canister module comprising a motor fan unit, the tool is coupled to the canister module by means of a suction hose, and the tool is vacuumed by means of the canister module.

In accordance with this use in accordance with the invention, the canister module has a motor fan unit. On the use in accordance with the invention, the cleaning head module—together with the suction hose or also without a suction hose—is separated from the canister module. In this respect, a further suction hose, e.g. a longer suction hose, is coupled or—in the event that the original suction hose of the autonomously operable vacuum cleaner is present, is still coupled thereto. An external tool can now be coupled to this suction hose; in this respect, coupling is to be understood such that the effective suction aperture of the suction hose is brought into the proximity of the working range of the tool at which a vacuuming should take place. This is the direct environment adjoining the working region e.g. with tools that work by chipping, grinding or cutting, for example with drills the region of the drill, with grinding tools the corresponding working region, with hedge shears, etc. the region of the cutting surface, etc. It is equally possible in this respect that the corresponding tools are already designed for the vacuuming of the working region and have a corresponding connector for a suction hose. In this case, the suction hose can also be directly coupled to a corresponding connection possibility of a tool.

The autonomously operable vacuum cleaner can thus also be used further flexibly—in addition to the autonomous vacuum cleaner function already initially described; the vacuuming of tools is in particular possible in this respect.

A further option of use provides that the initially named tools can be electrically supplied by the autonomously operable vacuum cleaner. Provision is made in this respect that the cleaning head module is separated from the canister module, that optionally comprises a motor fan unit, the tool is coupled to the canister module by means of an electrical line, and is supplied with electrical energy for operating the tool over said line.

A combination of the two previously named options is naturally also provided, i.e. an external tool can both be supplied with power by means of electrical energy via the canister module and a vacuuming of the tool can simultaneously take place.

There is naturally also the option with the previously named usage options that the control of the vacuum cleaner carrying out the navigation function is deactivated by a user in the autonomously operable vacuum cleaner, in particular in the canister module and the drive function is set to idle or is brought into an operating mode in which the control carrying out the navigation function allows the canister module to follow the user ("follow me" function).

The invention claimed is:

1. An autonomously operable vacuum cleaner, comprising a cleaning head module;

a canister module having rechargeable batteries that is separate from the cleaning head module and comprises a control that carries out a navigation function to provide an autonomous control of the vacuum cleaner; and a hose that fluidically and electrically connects the cleaning head module to the canister module, wherein both the cleaning head module and the canister module each have a drive mechanism that provides independent mobility to the respective modules; and wherein the canister module or the cleaning head module comprises a motor fan unit by which a vacuum is made possible to suck air into the canister module via the cleaning head module, and wherein a connection of the cleaning head module to the hose or the connection of the hose to the canister module is configured as releasable, and further wherein i) the cleaning head module is releasable from the hose connected to the canister module having a motor fan unit and is replaceable with a driveless cleaning head to be operated by a user or with a cleaning tool or the hose is releasable from the canister module having a motor fan unit together with the cleaning head module and is replaceable with a further hose to which a driveless cleaning head to be operated by a user or a cleaning tool, is attached; or ii) a suction pipe to be operated by the user is inserted between the hose and the cleaning head module and the cleaning head module is operable by the user by means of the suction pipe, wherein, in the event of replacement of the cleaning head module, the control of the vacuum cleaner carrying out the navigation function is deactivatable by a user and the drive function is capable of being set to idle or brought into an operating mode in which the control carrying out the navigation function allows the canister module to follow the user.

2. The autonomously operable vacuum cleaner in accordance with claim 1, wherein that the releasable connection of the cleaning head module to the hose or the connection of the hose to the canister module is configured as a plug-in connection, as a plug-in connection with a snap-in connection or as a screw connection.

3. The autonomously operable vacuum cleaner in accordance with claim 1, wherein the canister module provides power or control signals to the cleaning head module via at least one electric line that is integrated in or extends in parallel with the hose.

4. The autonomously operable vacuum cleaner in accordance with claim 3, wherein the at least one electric line is configured as releasable.

5. The autonomously operable vacuum cleaner in accordance with claim 4, wherein a plug-in connection of each electric line comprises a socket at the canister module and a plug connectable to the socket of the canister module at the hose and a socket at the cleaning head module and a further plug connectable to the socket of the cleaning head module at the hose; or a socket at the hose and a plug connectable to the socket of the hose at the canister module and a socket at the cleaning head module and a plug connectable to the socket of the cleaning head module at the hose; or a socket at the hose and a plug connectable to the socket of the hose at the canister module and a further socket at the canister module and a plug connectable to the further socket of the hose at the cleaning head module; or a socket at the canister module and a plug connectable to the socket of the canister module at the hose and a socket at the hose and a plug connectable to the socket of the hose at the cleaning head module.

6. The autonomously operable vacuum cleaner in accordance with claim 1, wherein the control receives or processes sensor input data of at least one sensor for mapping a surrounding space.

7. The autonomously operable vacuum cleaner in accordance with claim 1, wherein the canister module comprises at least one unit for separating sucked in dust.

8. The autonomously operable vacuum cleaner in accordance with claim 1, wherein the cleaning head module or a driveless cleaning head has at least one cleaning brush.

9. The autonomously operable vacuum cleaner in accordance with claim 3, wherein the at least one electric line is configured as releasable between the canister module and the hose or between the hose and the cleaning head module.

10. The autonomously operable vacuum cleaner in accordance with claim 3, wherein the at least one electric line is configured as a plug-in connection between the canister module and the hose or between the hose and the cleaning head module.

11. The autonomously operable vacuum cleaner in accordance with claim 1, wherein the cleaning tool comprises a crevice tool, an upholstery tool or a furniture brush.

12. The autonomously operable vacuum cleaner in accordance with claim 6, wherein the at least one sensor comprises a camera sensor, a sonar sensor, a lidar sensor, an infrared sensor or a 3D scanner sensor.

* * * * *